US008650698B2

(12) United States Patent
Dingert et al.

(10) Patent No.: US 8,650,698 B2
(45) Date of Patent: Feb. 18, 2014

(54) CLEANING APPLIANCE

(75) Inventors: Uwe Dingert, Abtsteinach (DE); Hans Jörg Clemen, Heidelberg (DE)

(73) Assignee: Carl Freudenberg KG, Weinheim (DE)

( * ) Notice: Subject to any disclaimer, the term of this patent is extended or adjusted under 35 U.S.C. 154(b) by 400 days.

(21) Appl. No.: 13/002,250

(22) PCT Filed: Jun. 26, 2009

(86) PCT No.: PCT/EP2009/004629
§ 371 (c)(1),
(2), (4) Date: Dec. 30, 2010

(87) PCT Pub. No.: WO2010/000420
PCT Pub. Date: Jan. 7, 2010

(65) Prior Publication Data

US 2011/0107539 A1 May 12, 2011

(30) Foreign Application Priority Data

Jun. 30, 2008 (DE) ..... 10 2008 030 309

(51) Int. Cl.
*A47L 13/24* (2006.01)
*A47L 13/44* (2006.01)

(52) U.S. Cl.
USPC ..... 15/231; 15/228; 15/229.1

(58) Field of Classification Search
USPC ..... 15/228, 229.1, 231
See application file for complete search history.

(56) References Cited

U.S. PATENT DOCUMENTS

| | | | | |
|---|---|---|---|---|
| 1,588,264 | A * | 6/1926 | Prendergast | 15/229.1 |
| 3,204,277 | A * | 9/1965 | Visman et al. | 15/244.1 |
| 5,115,535 | A | 5/1992 | Casademunt Ferre et al. | |
| 5,379,478 | A | 1/1995 | Vosbikian | |
| 5,715,560 | A | 2/1998 | Banicki | |
| 5,855,204 | A | 1/1999 | Gray et al. | |
| 5,953,784 | A | 9/1999 | Suzuki et al. | |
| 6,047,435 | A | 4/2000 | Suzuki et al. | |
| 2004/0016074 | A1 | 1/2004 | Tanaka | |
| 2006/0010633 | A1 | 1/2006 | Tanaka | |
| 2006/0195993 | A1 | 9/2006 | O'Neill et al. | |

FOREIGN PATENT DOCUMENTS

| | | |
|---|---|---|
| DE | 9418461.5 | 1/1995 |
| DE | 29920820 U1 | 2/2000 |
| EP | 0358844 A2 | 3/1990 |
| EP | 1097667 A1 | 5/2001 |
| WO | WO 2004/028332 A1 | 4/2004 |

* cited by examiner

*Primary Examiner* — Randall Chin
(74) *Attorney, Agent, or Firm* — Leydig, Voit & Mayer, Ltd.

(57) ABSTRACT

The invention relates to a cleaning appliance (1) including a wiper plate (2) having a central region (3) from which a plurality of arms (4) extend on both sides. The wiper plate (2) includes a cleaning side (5) to which a cleaning cloth (6) can be fixed. The cleaning cloth is placed on the floor to be cleaned, with a flat surface in the section associated with the central region (3), and essentially linearly in the sections associated with the arms (4).

31 Claims, 5 Drawing Sheets

CLEANING APPLIANCE

TECHNICAL FIELD

The present invention relates to a cleaning appliance with a wiper plate having a central region.

BACKGROUND OF THE INVENTION

Cleaning appliances designed for cleaning hard-to-reach spaces are known from the prior art. In particular, it is useful to design dusting cleaning appliances to also dust hard-to-reach spaces since dust tends to accumulate in such areas. The cleaning appliance disclosed in EP 1 097 667 B1 is especially well suited to clean floors in the vicinity of heating pipes. To this end, this cleaning appliance has recesses along the short sides of the wiper plate, which, when cleaning, can engage with heating pipes, thus making it possible to clean the floor in the vicinity of the heating pipes. Although this cleaning appliance provides large area coverage due to its flat cleaning surface, it can only be used to clean objects the dimensions of which are smaller than the width of the recess.

BRIEF SUMMARY OF THE INVENTION

The problem to be solved by the present invention is to provide a cleaning appliance that enables large area coverage even in hard-to-reach spaces.

To solve this problem, a cleaning appliance is provided that has a central region which is designed to serve as the wiper plate. The wiper plate has a cleaning surface to which a cleaning cloth can be attached. The cleaning cloth has a central base region and finger-shaped cleaning strips which at least partially surround, and are connected to, the base region along its outer circumference. The cleaning strips are disposed at a distance relative to, and adjacent to, one another along the outer circumference.

The cleaning strips can be connected to and disposed along the base region so as to be uniformly distributed in the circumferential direction around the base region.

In principle, the wiper plate and the base region could be designed so as to be largely congruent and connectable to each other. One possibility might be to connect only the wiper plate and the base region to each other. In this case, the cleaning strips would not be directly connected to the wiper plate but would be connected only by way of the base region. The wiper plate and the base region can be detachably connected to each other by means of an anchoring mechanism, for example, a hook and loop fastener.

At least the cleaning strips of the cleaning cloth can be made of a substantially dimensionally stable cleaning fabric. This cleaning fabric can, for example, have a felt-like structure. This embodiment is especially useful in cases in which the cleaning cloth is connected solely by way of its base region to the central region which is designed to serve as the wiper plate of the cleaning appliance since the strong dimensional stability of the cleaning strips makes the handling of the cleaning appliance easy and thus ensures excellent cleaning results.

Especially in cases in which a cleaning cloth with less dimensionally stable cleaning strips is used, it is useful for the cleaning strips to have arms in the form of reinforcing ribs on their upper surface that faces away from the cleaning surface. Even if relatively soft and dimensionally less stable cleaning cloths are used, the arms enhance the performance properties in that they ensure that the cleaning strips do not undergo undesirable bunching when the cleaning appliance is used.

In such a case, the arms that are disposed on the cleaning strips, together with the cleaning cloth, form a pre-assembled unit. This pre-assembled unit can be affixed to the wiper plate. Thus, when an old cleaning cloth is replaced with a new cloth, the arms are also new. As a result, the cleaning appliance continues to have consistently good performance properties over a long period of use.

On the surfaces that face one another, the arms and the central region, which is designed to serve as the wiper plate, are suitably connected to one another to ensure a reliable spatial correlation of the parts relative to one another.

The arms can also be connected in a star-like configuration to the central region and form a pre-assembled unit with the central region, as will be described below.

The cleaning appliance can also comprise a wiper plate having a central region with a plurality of arms projecting from both ends of the central region. The wiper plate has a cleaning surface to which a cleaning cloth can be attached. The cleaning cloth lies flat in the section associated with the central region and lies in an essentially linear configuration on the floor to be cleaned in the sections associated with the arms. The arms preferably have a length-to-width ratio of at least 2:1 to 20:1. The central region which is preferably designed to have an oval shape makes enables the cleaning of flat surfaces with large area coverage. The cleaning cloth that is associated with the flat area is able to pick up a large quantity of dust. Due to the arms, it is possible to readily reach even hard-to-reach spaces, for example, around the legs of tables and chairs. It is also conceivable for the wiper plate to comprise only a flat central region and for the arms to be shaped from the cleaning cloth which is attached to the central region. In such a case, it is possible to integrate relatively rigid elements into the cleaning cloth. These elements subsequently form the arms. However, it is also possible to dispose a number of slits along the circumference of the cleaning cloth. With this arrangement, wuch slits subsequently form the arms.

The arms can be connected in a star-like configuration to the central region. In this case, the aims, move away from one another in the direction of their free ends so that the spacing between the arms becomes increasingly larger. This allows the cleaning appliance to be moved around objects with different maximum different thicknesses, with the arms being in direct contact with the object and thus allowing the areas around the object to be cleaned as well.

The arms can be designed and disposed in such a manner that the wiper plate has a rectangular boundary edge. This embodiment allows the wiper plate to be fitted with other commercially available cleaning cloths, and the cleaning of large surfaces does not differ from the normal cleaning with other rectangular wiper plates. The arms can also have a trapezoidal boundary edge, thus providing an even better around-the-corner maneuverability. The boundary edge can also be oval.

The arms can be spring-mounted on the central region. This allows the arms to move both in the horizontal and in the vertical direction. As a result, the arms can be moved especially close to the objects to be cleaned with the arms being able to spread apart and with the spacing between the arms being able to adjust to objects around which the floor is to be cleaned. The arms can be disposed on the central region in such a manner that they are tilted with respect to the central region and are the first to make contact with the floor that is to be cleaned. The central region or the area of the cleaning cloth associated with the central region can be fitted with especially abrasive means which, when pressure is exerted on the handle, make contact with the floor to be cleaned and improve the cleaning action by removing stubbornly adhering soil.

The arms can be affixed to the central region via joining strips. Such joining strips are especially easy to produce and can be made of the same material as, and integrally formed in one piece with, the arms and/or the central region. Alternatively, however, the joining strips can also be made of a different material.

The joining strips can be designed so as to allow the arms to move essentially only in the horizontal direction. In this embodiment, it is always ensured that the arms are in close pressing contact with the floor to be cleaned. The arms can only swerve and spread in the horizontal direction. This is the case especially if the joining strips extend essentially in the vertical direction and have a narrow width. The joining strips can also be designed so as to create an elastic movement.

The arms can be made of the same material as, and integrally formed in one piece with, the central region. This simplifies the production of the wiper plate.

Spring bodies can be disposed between the arms. The spring bodies compress when the spacing between the arms changes because of a horizontal movement and thus prevent excessive stress on the joining strips.

The spring bodies can be made of a thermoplastic elastomer material. Such elastic materials can be produced by means of injection molding and, in particular, by means of two-component injection molding and can be formed in one piece with the central region and the aims.

A handle attachment mechanism can be integrated into the central region. The handle is preferably attached by way of a universal joint so that good maneuverability is ensured. In addition, the handle attachment mechanism can be disposed so as to be elevated with respect to the back surface of the central region of the wiper plate. In this case, the handle can be tilted especially sharply, thereby making it possible to clean surfaces underneath objects, such as tables, cabinets and other pieces of furniture. To enhance this effect even further, the area around the handle attachment mechanism can, for example, be hemispherically recessed.

The cleaning surface can be fitted with anchoring mechanisms. Such anchoring mechanisms include, in particular, hook and loop fasteners or elastomer coatings with a strong anchoring action. This makes it possible to attach cleaning cloths without the use of pockets, which is especially useful because of the arms and the open spaces in between.

BRIEF DESCRIPTION OF THE SEVERAL VIEWS OF THE DRAWINGS

A few practical examples of the cleaning appliance according to the present invention will be explained in greater detail based on the following figures.

DETAILED DESCRIPTION OF THE INVENTION

Figure 1:
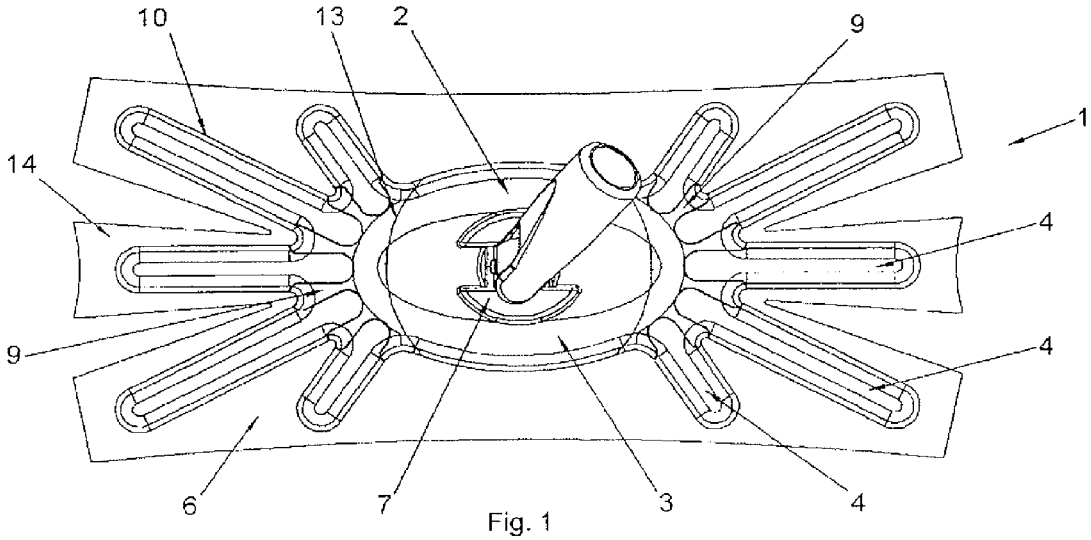
FIG. 1 is a schematic top view of a cleaning appliance with a cleaning cloth.

FIG. 1 illustrates a cleaning appliance 1 designed as a dust wiping appliance for cleaning dry surfaces. The cleaning appliance 1 includes a wiper plate 2 having a central region 3 from both ends of which five arms 4 each extend in a ray-shaped configuration. A cleaning cloth 6 is detachably secured by an anchoring mechanism 10 in the form of a hook and loop fastener to the cleaning surface 5 of the wiper plate 2, i.e., the lower surface. In the section associated with the central region 3, the cleaning cloth 6 lies flat, and in the sections associated with the arms 4 it lies in a linear configuration, on the floor to be cleaned. A handle attachment mechanism 7 is integrated into the central region 3. The arms 4 are attached to the central region 3 in a star-like configuration and are designed and disposed in such a manner that the wiper plate 2 has a rectangular boundary edge. The aims 4 are spring-mounted on the central region 3 via joining strips 8, with the arms 4, the joining strips 8 and the central region 3 being made of the same material and being integrally formed in one piece. Disposed between the arms 4 are spring bodies 9 which are made of a thermoplastic elastomer material.

FIG. 1 also shows a cleaning appliance 1 with a central region 3 which is designed to serve as the wiper plate 2. The cleaning cloth 6 can be detachably and non-destructively secured to the cleaning surface 5 of the wiper plate 2. Along the outer circumference of the central base region 13, the finger-shaped cleaning strips 14 are disposed such that they extend generally in the direction of the long sides of the cleaning cloth. The arms 4 which serve as reinforcing ribs can be disposed on the upper surface of the cleaning strips 14 which faces away from the cleaning surface 5.

Figure 5:
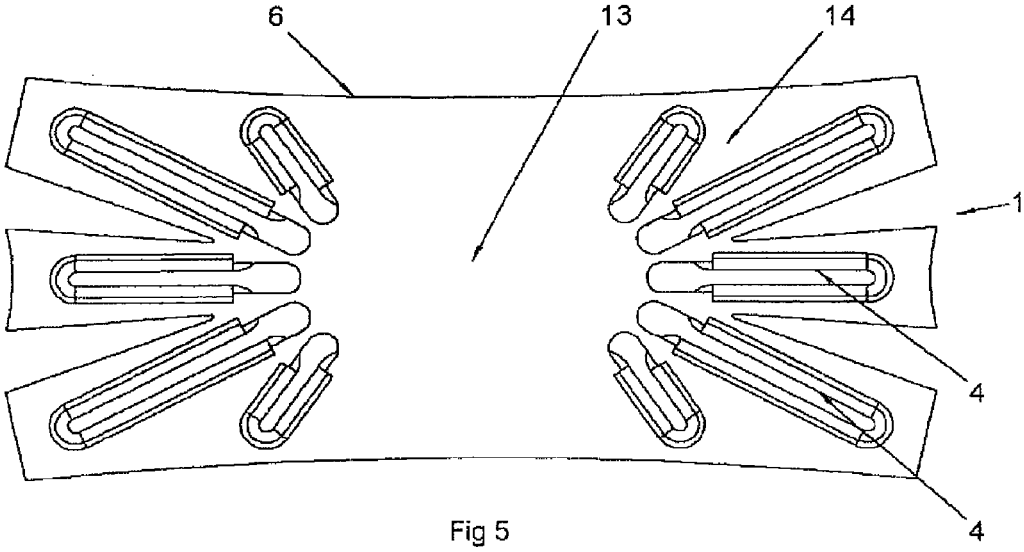
FIG. 5 is a schematic top view of an embodiment of a cleaning cloth with integrated arms.

The arms 4 bring greater dimensional stability to the cleaning cloth 6. The cleaning strips 14 of the cleaning cloth 6 and the arms 4 can form a pre-assembled unit which can be secured to the wiper plate 2. This pre-assembled unit is shown in FIG. 5.

The arms 4 and the central region 3 are suitably connected to one another on the surfaces that face one another to ensure a reliable spatial correlation of the parts relative to one another.

If the cleaning cloth 6 with its finger-shaped cleaning strips 14 has a dimensionally fairly stable structure, the arms described above are not needed. Such a dimensionally stable cleaning cloth 6 can be made, for example, of a felt-like material.

Figure 2:
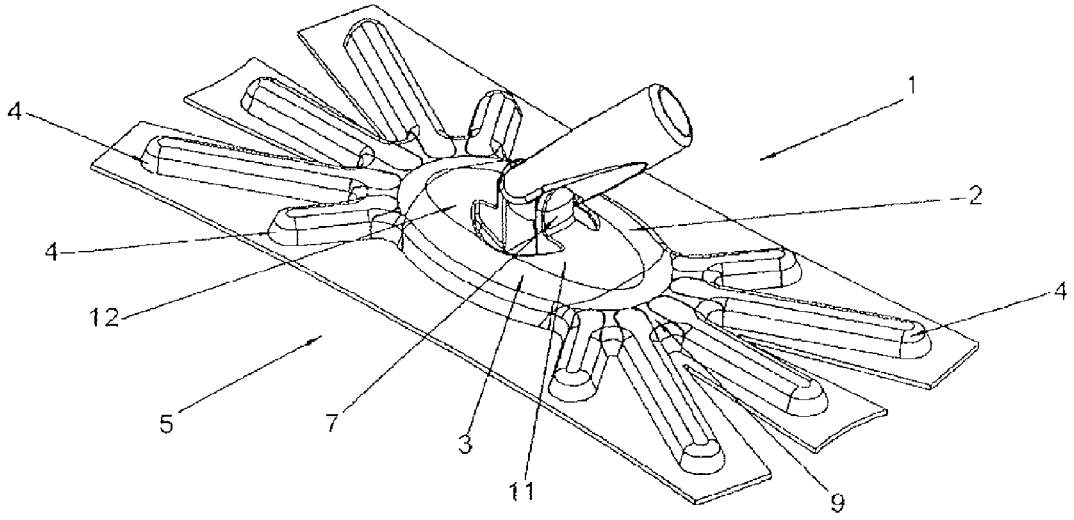
FIG. 2 is a schematic perspective view of the cleaning appliance of FIG. 1.

FIG. 2 provides a perspective view of the wiper plate 2 of the cleaning appliance 1 seen in FIG. 1. The handle attachment mechanism 7 in the central region 3 of the wiper plate is disposed so as to be elevated relative to the back surface 11 of the central region 3. A recess 12 is disposed in the central region 3 in the area around the handle attachment mechanism 7.

Figure 3:
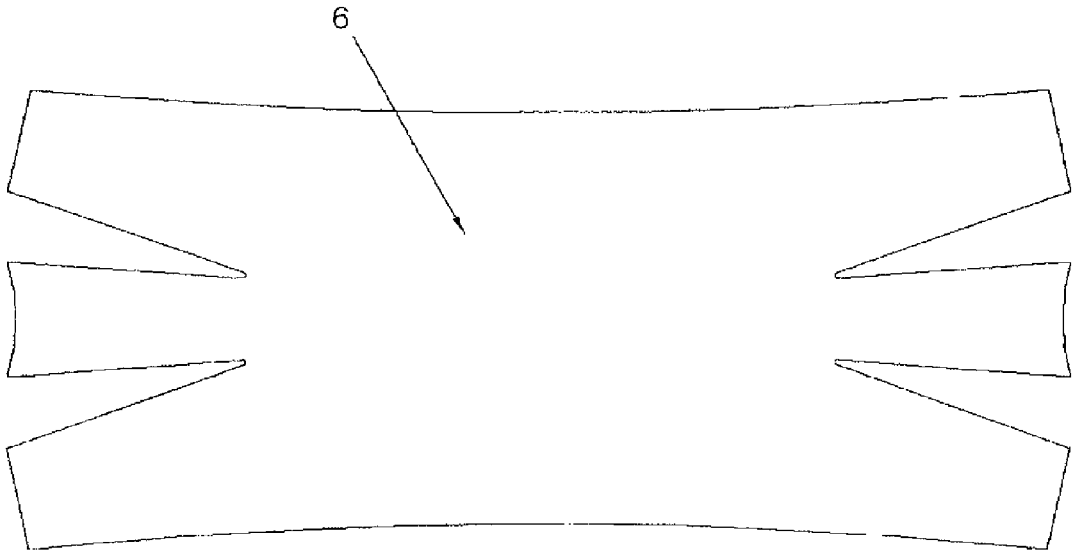
FIG. 3 is a schematic top view of the cleaning cloth.

FIG. 3 illustrates a cleaning cloth 6 for the cleaning appliance 1 shown in FIGS. 1 and 2. A fleece material is disposed on the back surface of the cleaning cloth 6 so as to be able to attach the cleaning cloth 6 to the wiper plate 2. The cleaning cloth has two slits along each of the two short sides which correspond to the open spaces between the three laterally projecting arms 4 of the wiper plate 2.

Figure 4:
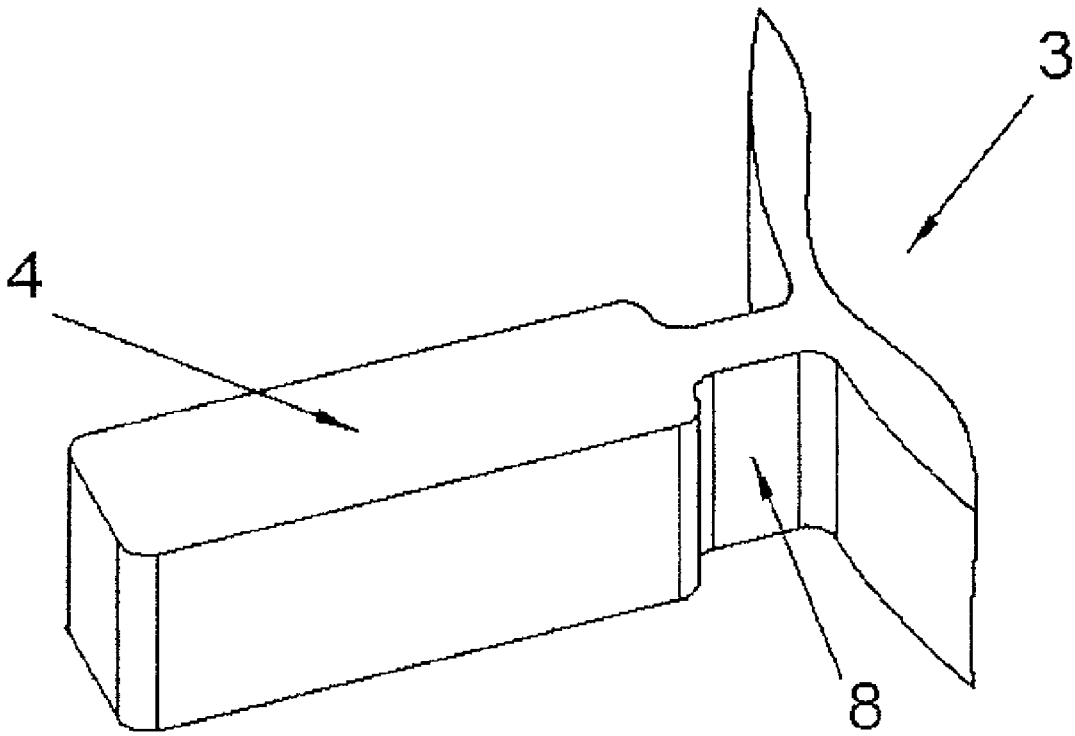
FIG. 4 is a schematic perspective view of a mechanism for attaching the aims to the central region.

FIG. 4 shows a detailed view of the mechanism for attaching the arms 4 by the joining strips 8 to the central region 3. The joining strips 8 are designed in such a manner that the arms 4 can essentially move only in the horizontal direction, thus resulting in an elastic attachment of the arms 4 to the central region 3.

FIG. 5 shows a cleaning cloth 6 which has finger-shaped cleaning strips 14 extending generally in the direction of the two long sides of the central base region 13. One arm 4 each is disposed on the upper surface of the cleaning strips 14, with the arms 4 serving as reinforcing ribs for the cleaning strips 14.

The cleaning cloth 14 and the arms 4 form a pre-assembled unit which is detachably and non-destructively secured to the wiper plate 2 (cf. FIGS. 1 and 2). On the surfaces that face one another, the arms 4 and the wiper plate 2 are connected to one another, for example, by a plug-in connection so that a reliable spatial correlation of the parts relative to one another is ensured.

The invention claimed is:

1. A cleaning appliance comprising a central region which is configured to serve as a wiper plate, the wiper plate having a cleaning surface to which a cleaning cloth is attachable, the cleaning cloth having a central base region and finger-shaped cleaning strips which at least partially surround, and are connected to, the base region along an outer circumference of the base region, the cleaning strips being arranged such that adjacent cleaning strips are in spaced relation with respect to one another along the outer circumference, wherein the cleaning strips are made of a substantially dimensionally stable cleaning fabric and have arms that are configured as reinforcing ribs on an upper surface that faces away from the cleaning surface, wherein the arms are attached in a star-like configuration to the central region.

2. The cleaning appliance as to claim 1, wherein the arms are configured and disposed in such a manner that the wiper plate has a rectangular boundary edge.

3. The cleaning appliance as to claim 1, wherein the arms are made of the same material as, and integrally formed in one piece with, the central region.

4. The cleaning appliance as to claim 1, wherein a handle attachment mechanism is integrated into the central region.

5. The cleaning appliance as to claim 1, wherein the cleaning surface is fitted with an anchoring mechanism,

6. A cleaning appliance comprising a wiper plate having a central region with a pair of sides from which a plurality of arms extend, the arms being spring mounted to the central region, the wiper plate having a cleaning surface to which a cleaning cloth can be attached, the cleaning cloth having a section associated with the central region that lies flat on a floor to be cleaned, the cleaning cloth having sections associated with the arms that lie in a linear configuration on a floor to be cleaned.

7. The cleaning appliance as to claim 6, wherein the arms are attached in a star-like configuration to the central region.

8. The cleaning appliance as to claim 6, wherein the arms are affixed to the central region via joining strips.

9. The cleaning appliance as to claim 6, wherein the joining strips are configured such that the arms are substantially movable only in a horizontal direction.

10. The cleaning appliance as to claim 6, wherein the arms are made of the same material as, and integrally formed in one piece with, the central region.

11. The cleaning appliance as to claim 6, wherein spring bodies are disposed between the arms.

12. The cleaning appliance as in claim 11, wherein the spring bodies are made of a thermoplastic elastomer material.

13. The cleaning appliance as to claim 6, wherein a handle attachment mechanism is integrated into the central region.

14. The cleaning appliance as to claim 6, wherein the cleaning surface is fitted with an anchoring mechanism.

15. A cleaning appliance comprising a central region which is configured to serve as a wiper plate, the wiper plate having a cleaning surface to which a cleaning cloth is attachable, the cleaning cloth having a central base region and finger-shaped cleaning strips which at least partially surround, and are connected to, the base region along an outer circumference of the base region, the cleaning strips being arranged such that adjacent cleaning strips are in spaced relation with respect to one another along the outer circumference, wherein the cleaning strips are made of a substantially dimensionally stable cleaning fabric and have arms that are configured as reinforcing ribs on an upper surface that faces away from the cleaning surface, wherein the arms are spring-mounted on the central region.

16. The cleaning appliance as to claim 15, wherein the arms are configured and disposed in such a manner that the wiper plate has a rectangular boundary edge.

17. The cleaning appliance as to claim 15, wherein the arms are made of the same material as, and integrally formed in one piece with, the central region.

18. The cleaning appliance as to claim 15, wherein a handle attachment mechanism is integrated into the central region.

19. The cleaning appliance as to claim 15, wherein the cleaning surface is fitted with an anchoring mechanism.

20. A cleaning appliance comprising a central region which is configured to serve as a wiper plate, the wiper plate having a cleaning surface to which a cleaning cloth is attachable, the cleaning cloth having a central base region and finger-shaped cleaning strips which at least partially surround, and are connected to, the base region along an outer circumference of the base region, the cleaning strips being arranged such that adjacent cleaning strips are in spaced relation with respect to one another along the outer circumference, wherein the cleaning strips are made of a substantially dimensionally stable cleaning fabric and have arms that are configured as reinforcing ribs on an upper surface that faces away from the cleaning surface, wherein the arms are affixed to the central region via joining strips.

21. The cleaning appliance as to claim 20, wherein the joining strips are configured such that the arms are substantially movable only in a horizontal direction.

22. The cleaning appliance as to claim 20, wherein the arms are configured and disposed in such a manner that the wiper plate has a rectangular boundary edge.

23. The cleaning appliance as to claim 20, wherein the arms are made of the same material as, integrally formed in one piece with, the central region.

24. The cleaning appliance as to claim 20, wherein a handle attachment mechanism is integrated into the central region.

25. The cleaning appliance as to claim 20, wherein the cleaning surface is fitted with an anchoring mechanism.

26. A cleaning appliance comprising a central region which is configured to serve as a wiper plate, the wiper plate having a cleaning surface to which a cleaning cloth is attachable, the cleaning cloth having a central base region and finger-shaped cleaning strips which at least partially surround, and are connected to, the base region along an outer circumference of the base region, the cleaning strips being arranged such that adjacent cleaning strips are in spaced relation with respect to one another along the outer circumference, wherein the cleaning strips are made of a substantially dimensionally stable cleaning fabric and have arms that are configured as reinforcing ribs on an upper surface that faces away from the cleaning surface, wherein spring bodies are disposed between the arms.

27. The cleaning appliance as in claim 26, wherein the spring bodies are made of a thermoplastic elastomer material.

28. The cleaning appliance as to claim 26, wherein the arms are configured and disposed in such a manner that the wiper plate has a rectangular boundary edge.

29. The cleaning appliance as to claim 26, wherein the arms are made of the same material as, and integrally formed in one piece with, the central region.

30. The cleaning appliance as to claim 26, wherein a handle attachment mechanism is integrated into the central region.

31. The cleaning appliance as to claim 26, wherein the cleaning surface is fitted with an anchoring mechanism.

* * * * *